US005890953A

United States Patent [19]

Evensen

[11] Patent Number: 5,890,953

[45] **Date of Patent: *Apr. 6, 1999**

[54] METHOD FOR APPARATUS FOR ABRADING AND A ROTATING ROLLER THEREFOR

[76] Inventor: Kenneth Evensen, 1429 Fremont Ave., Bartlett, Ill. 60103

[ * ] Notice: The term of this patent shall not extend beyond the expiration date of Pat. No. 5,564,971.

[21] Appl. No.: 729,336

[22] Filed: Oct. 15, 1996

Related U.S. Application Data

[63] Continuation-in-part of Ser. No. 324,806, Oct. 18, 1994, Pat. No. 5,564,971, and a continuation-in-part of Ser. No. 409,863, Apr. 26, 1995, Pat. No. 5,567,197.

[51] Int. Cl.[6] ..... B24D 9/02

[52] U.S. Cl. ..... 451/504; 451/495; 451/490; 451/508

[58] Field of Search ..... 457/344, 350, 457/352, 358, 490, 495, 504, 506, 507, 508, 509, 573, 514, 516, 526, 528, 538, 539

[56] References Cited

U.S. PATENT DOCUMENTS

| | | | |
|---|---|---|---|
| 1,325,937 | 12/1919 | Fox . | |
| 2,221,173 | 11/1940 | Gutsell | 451/506 |
| 2,483,422 | 10/1949 | Larson | 451/506 |
| 3,597,883 | 8/1971 | Choplin | 451/358 |
| 3,688,453 | 9/1972 | Legacy et al. | 51/400 |
| 3,790,980 | 2/1974 | Sylvie | 15/23 |
| 3,793,782 | 2/1974 | Bowling | 51/150 |
| 4,177,611 | 12/1979 | Carr-Rollett | 51/376 |
| 4,380,092 | 4/1983 | Brothers | 15/209 |
| 4,694,616 | 9/1987 | Lindberg | 51/170 |
| 5,007,208 | 4/1991 | Garfield | 51/281 |
| 5,380,239 | 1/1995 | Casillasa et al. | 451/538 |
| 5,564,971 | 10/1996 | Evensen | 451/504 |

*Primary Examiner*—Eileen P. Morgan
*Attorney, Agent, or Firm*—Fitch, Even, Tabin, & Flannery

[57] ABSTRACT

A hard, sanding roller has a cylindrical sleeve that can be telescoped onto and removed from and clutched to a hard, supporting roller or drum This is achieved by a one-way, clutch mechanism between the supporting roller and abrasive sleeve that allows axially sliding and rotational turning when sliding the sleeve onto the roller and turning the sleeve in the non-sanding direction, and this clutch mechanism drives the sleeve without rotational turning of the sleeve relative to the roller when abrading. The inner surface of the abrading roller carries one-half of a clutch surface; and the mating roller surface carries the other half of the clutch surface. The one-way clutch does not interfere with abrading action and is very inexpensive, particularly on the sleeve, which is disposable The one-way clutch half on the sleeve may be formed from a thin layer of looped material, such as sewing fleece or a Velcro material, which hooks into hooks or barbs on the supporting roller when the roller is turned in the direction of abrading. When the sleeve is turned in the opposite, non-abrading direction, the barbs or hooks slide over the loop without catching the same and a simultaneously turning and axially directed force on the sleeve will pull the sleeve from the roller.

23 Claims, 6 Drawing Sheets

METHOD FOR APPARATUS FOR ABRADING AND A ROTATING ROLLER THEREFOR

BACKGROUND OF THE INVENTION

This application is a Continuation-in-Part of applications Ser. No. 08/324,806, filed Oct. 18, 1994 now U.S. Pat. No. 5,564,971 and Ser. No. 08/409,863, filed Apr. 26, 1995 now U.S. Pat. No. 5,567,197.

The above-identified patent applications disclose (although their claims are not limited to) a soft roller system in which there is a soft cushioned, rotating, abrasive roller that conforms to and rides on the wood surface which is particularly suited for sanding wide and relatively flat surfaces. The above-described patent applications disclosed one-way clutch mechanisms that allow the easy attachment of and removal of sanding sleeves from a soft rotating roller. The present invention, on the other hand, is directed to providing an improved roller and sanding sleeve for hard rollers that cannot be compressed as can the soft roller. In the soft roller system, the sleeve internal diameter is preferably slightly smaller than the soft roller outer diameter such that the soft roller is slightly compressed by the sleeve on the soft roller. The present invention is directed to hard rollers where the roller is not compressed in diameter by the sleeve. The term hard roller as used herein also refers to inflated rollers that have a pneumatically or liquid inflated roller body that is hard when expanded and in use. While such fluid inflated rollers allow a more rapid change of the sanding sleeves, they also are handicapped in that one must have access to a source of compressed air to expand the inflatable roller. Further, the provision of expandable bladder, air fittings and the like add considerably to the cost of the inflatable roller system. There are also hard rollers, often called drum sanders, in which a sanding strip was spirally wrapped about the drum sander and adhered to surface of the drum with an adhesive. There is a need for an improved manner of applying and removing a cylindrically abrasive roller from a cylindrical roller including drum rollers of any size in diameter or length.

SUMMARY OF THE INVENTION

In accordance with the present invention, there is provided a hard, sanding roller with a cylindrical sleeve that can be telescoped onto and removed from and clutched to a hard, supporting roller or drum. This is achieved by a one-way, clutch mechanism between the supporting roller and abrasive sleeve that allows axially sliding and rotational turning when sliding the sleeve onto the roller and turning the sleeve in the non-sanding direction, and this clutch mechanism drives the sleeve without rotational turning of the sleeve relative to the roller when abrading. The preferred sleeve-roller system may be called a one-way clutch system in that the inner surface of the abrading roller carries one-half of a clutch surface; and the mating roller surface carries the other half of the clutch surface. The one-way clutch does not interfere with abrading action and is very inexpensive, particularly on the sleeve, which is disposable. In the preferred embodiment of the invention, the one-way clutch half on the sleeve is a thin layer of looped material, such as sewing fleece or a Velcro material, which hooks into hooks or barbs on the supporting roller when the roller is turned in the direction of abrading. When the sleeve is turned in the opposite, non-abrading direction, the barbs or hooks slide over the loop without catching the same and a simultaneously turning and axially directed force on the sleeve will pull the sleeve from the roller.

The preferred, sleeve material is a thin layer of material adhered to the underside of an abrading sheet; and the preferred hooks or barbs are formed on free edges of a plurality of flexible strips laid about the periphery of the roller. The illustrated flexible strips are thin strips of plastic which bend down easily against the circumference of the roller and have stiffness when forces are exerted on their edges by the multiple barbs pushing the sleeve to drive the sleeve in the rotating direction.

The hard roller may be formed of various materials such as plastic or metal. Often, the very large drum sanders have a metal cylindrical drum to which the abrading material is attached in various manners. Such existing drums may be converted, i.e., retrofitted by attaching a one-way clutch means, e.g., the toothed flexible strips of plastic, to the cylindrical drum surface and then using cylindrically abrading sleeves having the other way clutch material on the interior cylindrical surface of the sleeve. The one-way clutch means remains on the drum, and the disposable, abrading sleeves are telescoped on and off the drum.

DETAILED DESCRIPTION OF THE PREFERRED EMBODIMENT

Figure 1:
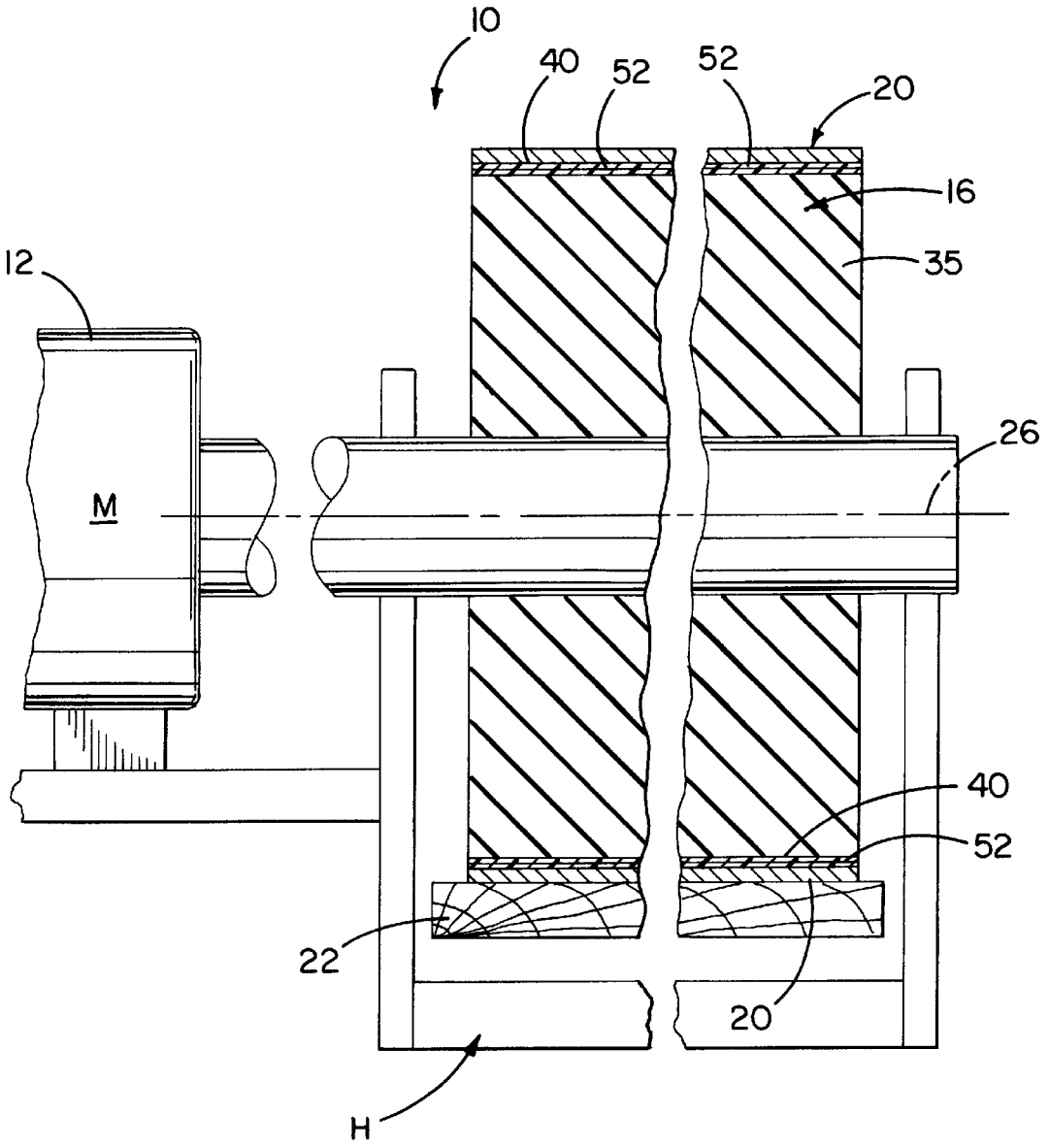
FIG. 1 is a view of a motor driven sanding apparatus.

As shown in the drawings, for purposes of illustration, the invention is embodied in an abrading apparatus 10 (FIG. 1) having a frame 11 and a motor 12 for rotating a roller 14 which comprises a drum 16 with a removable, abrading cylindrical sleeve 20 thereon. The abrading apparatus 10 may be either a hand-held device that is carried by the user across a stationary workpiece 22; or abrading apparatus may be a large, heavy drum-type of sanding apparatus. In the stationary, heavy drum apparatus, the workpiece is carried or transported beneath the rotating roller that does not translate and is fixedly mounted in a frame (not shown) of the apparatus to rotate about a fixed axis 26 through the center of the roller.

In conventional rotating drum sanders, the drum is usually a large metal drum with a metal drum surface that is cylindrical. Often the disposable abrading material is on an elongated sheet that is cut along a diagonal or bias; and the sheet is wrapped about the metal drum surface and is adhered thereto leaving a seam along a helical line. In other conventional drum sanders, a pneumatic bladder drum is used with an abrading sleeve being telescoped onto the drum, while the bladder is contracted. Then, air under higher pressure is admitted into the bladder and causes the bladder diameter to expand and to tightly grip the cylindrical sleeve. The problem with these bladder drum sanders is that one must provide and use a source of compressed air at the sander. The use and provision of air for a small home sander makes it undesirable to many homeowners or do-it-yourselfers. Many professional users of rotating roller sanders do not want to carry, hook up and transport air hoses for a bladder sander at a large building construction or at a remote job site. Thus, there is a need for a new improved manner of attaching and detaching cylindrical abrading sleeves to a hard material, cylinder drum.

Figure 2:
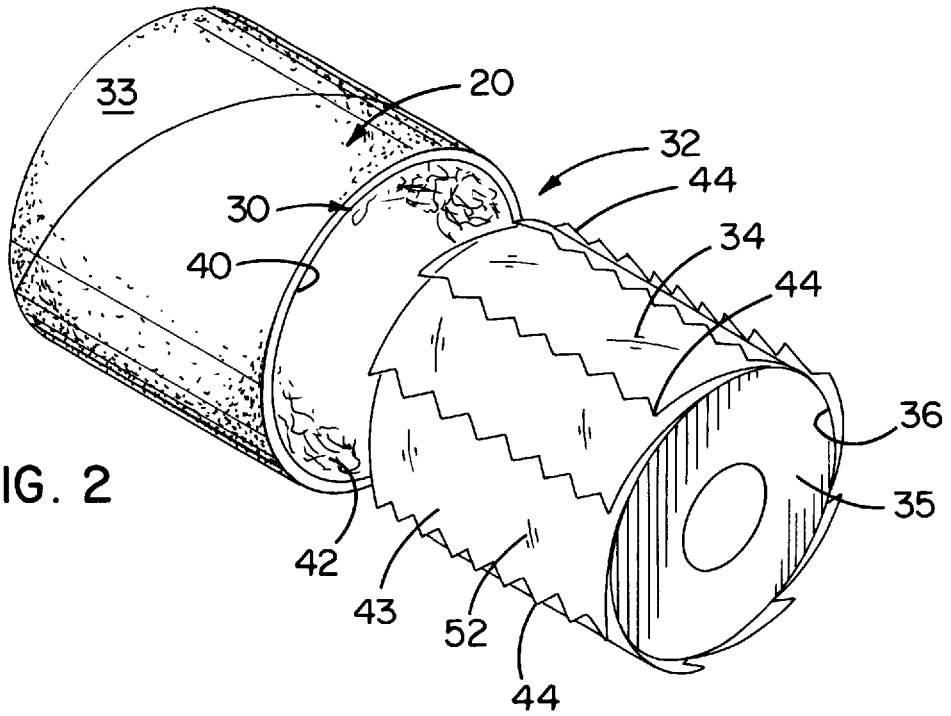
FIG. 2 is an exploded, perspective view of a sanding sleeve and a hard roller with the preferred one-way clutch means therebetween.
Figure 3:
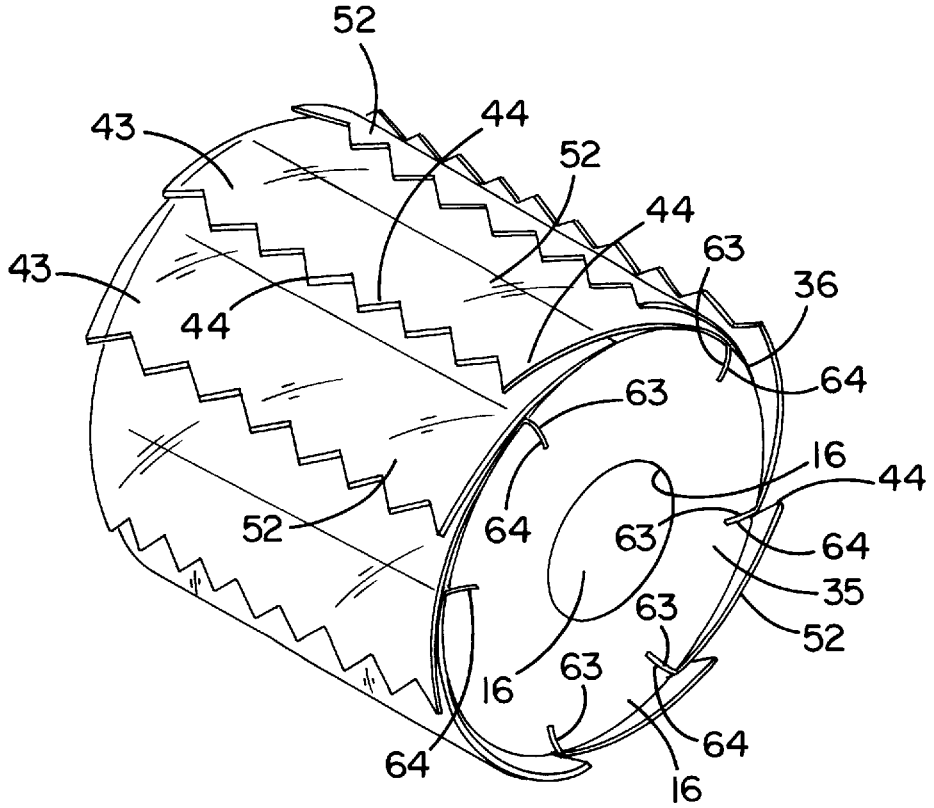
FIG. 3 is an enlarged, perspective view of the roller shown in FIG. 1.
Figure 4:
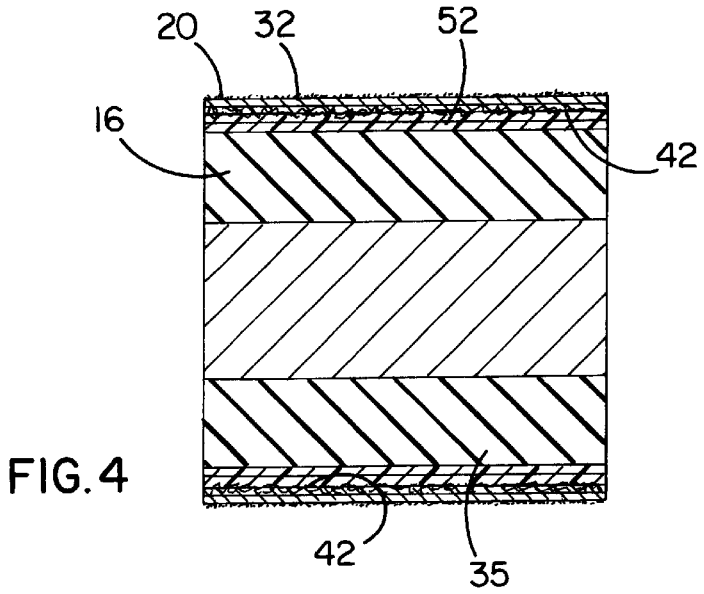
FIG. 4 is a cross-sectional view taken on an axial line through the hard drum, one-way clutch mechanism and abrading sleeve.

In accordance with the present invention, the abrading sleeve 20 has provided on its inner cylindrical surface a first clutch half 30 of a one-way clutch mechanism 32 that cooperates with a second clutch half 34 of the one-way clutch mechanism, the second half being on a cylindrical surface 36 of the drum 16. The one-way clutch mechanism allows a twisting and turning of the outer sleeve 20 relative to the drum 16, as the sleeve is being slid by pushing or pulling it onto the drum with the one-way clutch mechanism being disconnected. When one tries to twist or turn the sleeve in the other direction, the one-way clutch mechanism is engaged and prevents twisting of the sleeve relative to the drum. This occurs when the drum is driven by the motor 12, and the drum 16 is turned in the direction for abrading which is counterclockwise in FIG. 2.

The one-way clutch mechanism 32 should be inexpensive and non-interfering with the abrading operation and leave a non-smooth outer abrading surface 33 on the abrading roller. Often the abrading surface is no more than a tubular sheet of sandpaper; and the first clutch mechanism should be thin and inexpensive because it is a disposable item attached to the inner face of the sandpaper. To this end, the preferred one-way clutch half 30 is a sheet 40 of thin material having loops or hooks 42 thereon for hooking connection with barbs or teeth 44 of the second clutch half 34 on the drum 16. The illustrated and preferred material is a coarse, looped, textile material used in garments, and it is often called a "sewing fleece". The thin substrate sheet of sewing fleece is preferably adhered by an adhesive 45 to the interior side of the sandpaper sheet. Another, but more expensive, material is a sheet of the loop portion of a Velcro assembly with the hooks or barbs being on a cylindrical sheet secured to the sleeve's internal surface. Also, any ordinary scrim fabric therein has holes therein to accept to accept the teeth 44 of the plastic strips may be used.

The one-way clutch 32 interconnection between the sleeve 20 and the drive drum 16 preferably comprises a series of elongated, serrated plastic strips 52 wrapped circumferentially about the drum 16. The serrated edges 43 of the plastic clutch strips 52 engage and hook into the loops of the looped material when the drive roller is rotated in the driving direction shown by directional arrow B in FIG. 2. The engagement strips 52 have a front end or edge and a back end or edge 64. The back end 64 of each engagement strip is attached to the hard roller body 35 by an adhesive, such as glue or tape. Also, it is preferred that slits 63 be formed in the outer periphery of the roller body and that back edges or ends 64 of the strips 52 be bent at about 90° and forced into the slits to anchor the strip ends 64 to the hard roller body 35.

The front toothed edge 43 of each engagement strip 52 is free, i.e., not attached to the hard roller body. The engagement strips 52 are flexible so that the stirps 52 can be resiliently bent down to conform to a curved portion of the circumference of the hard drum body 35. The attached strips 52 are preferably positioned on the hard rubber body so that when the strips are bent to conform to the rounded shape of the body and tube, the loose front edge 43 of each engagement strip overlaps the attached back end 64 of the engagement strip just in front of it. Also, a sufficient number of engagement strips are used so that the engagement strips completely cover the hard drum body in the described overlapping manner.

The combined diameter of the drum body 35 and the thickness of the overlapped plastic strips 52 attached to the drum body is slightly smaller than an inner diameter of the sanding sleeve 20.

Figures 6, 7:
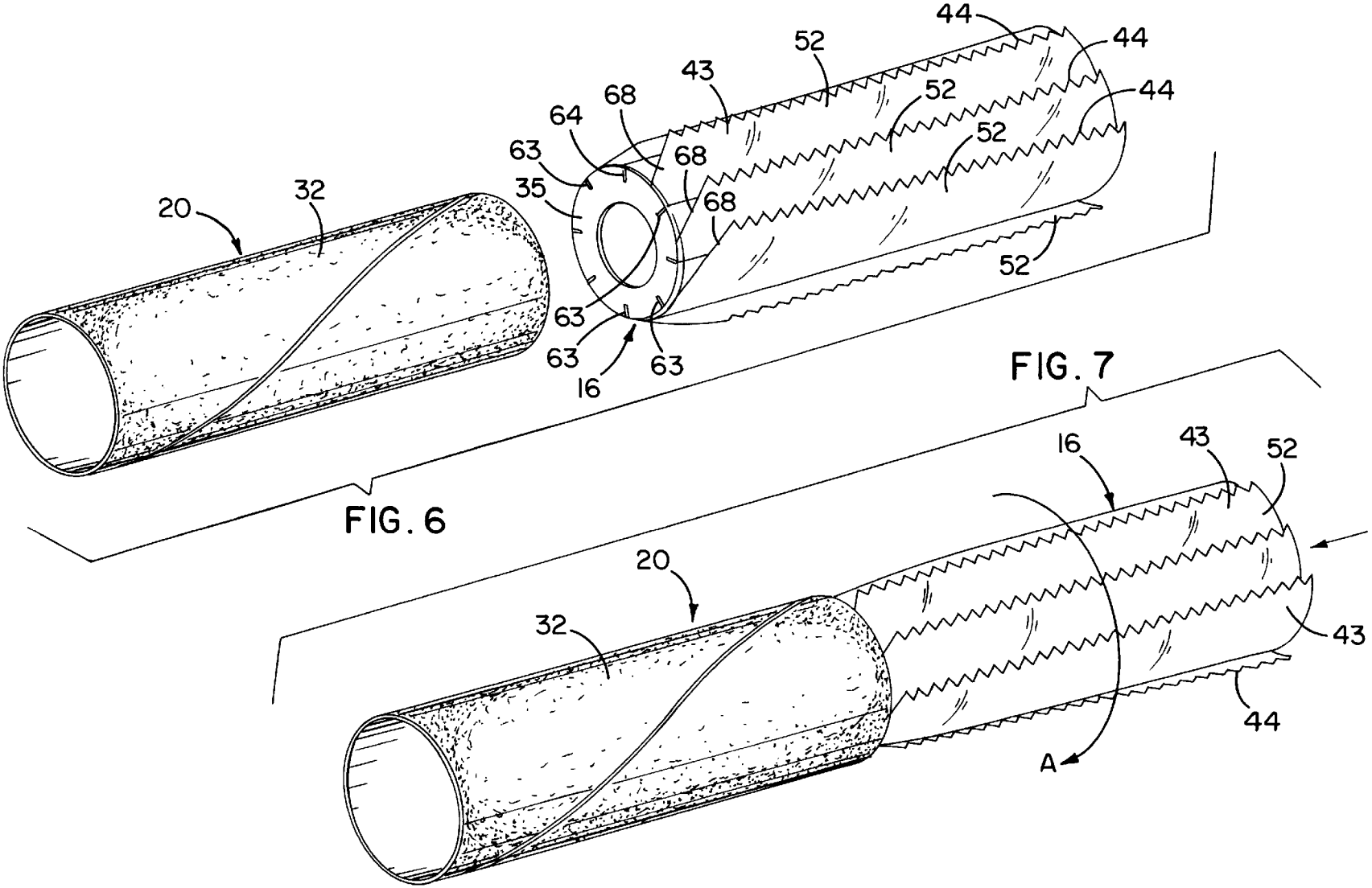
FIG. 6 is an exploded perspective view of the camming edge on the flexible strips to aid in telescoping the sleeve onto the roller.
FIG. 7 shows the sleeve of FIG. 6 being inserted to cam the edges of the strips on the roller.

To assist in telescoping the sleeve 20 onto the drum 16, it is preferred to make outer side ends 66 (FIG. 8) of the strips 52 formed with a camming or sloped edge 68 that serves to bend down the end strips 52 against the hard roller body, as shown in FIG. 7. The sloped edge 68 is formed by a 45° cut to remove a square corner of the strip. The sleeve 20 must be simultaneously pushed into the drum 16 and rotated in a first direction, with respect to the drum, as shown by an arrow A in FIG. 7. Also, when turned in this direction, the teeth of the plastic stirps 52 will not engage the looped material 42 on the inner surface of the sleeve 20. When the sleeve is rotated in direction A, the plastic strips 52 on the drum easily slide along the looped material and the sleeve is easily inserted into the roller. The direction of rotation of the sleeve in the first direction A, as shown in FIG. 7, is clockwise with respect to the drum.

Figure 8:
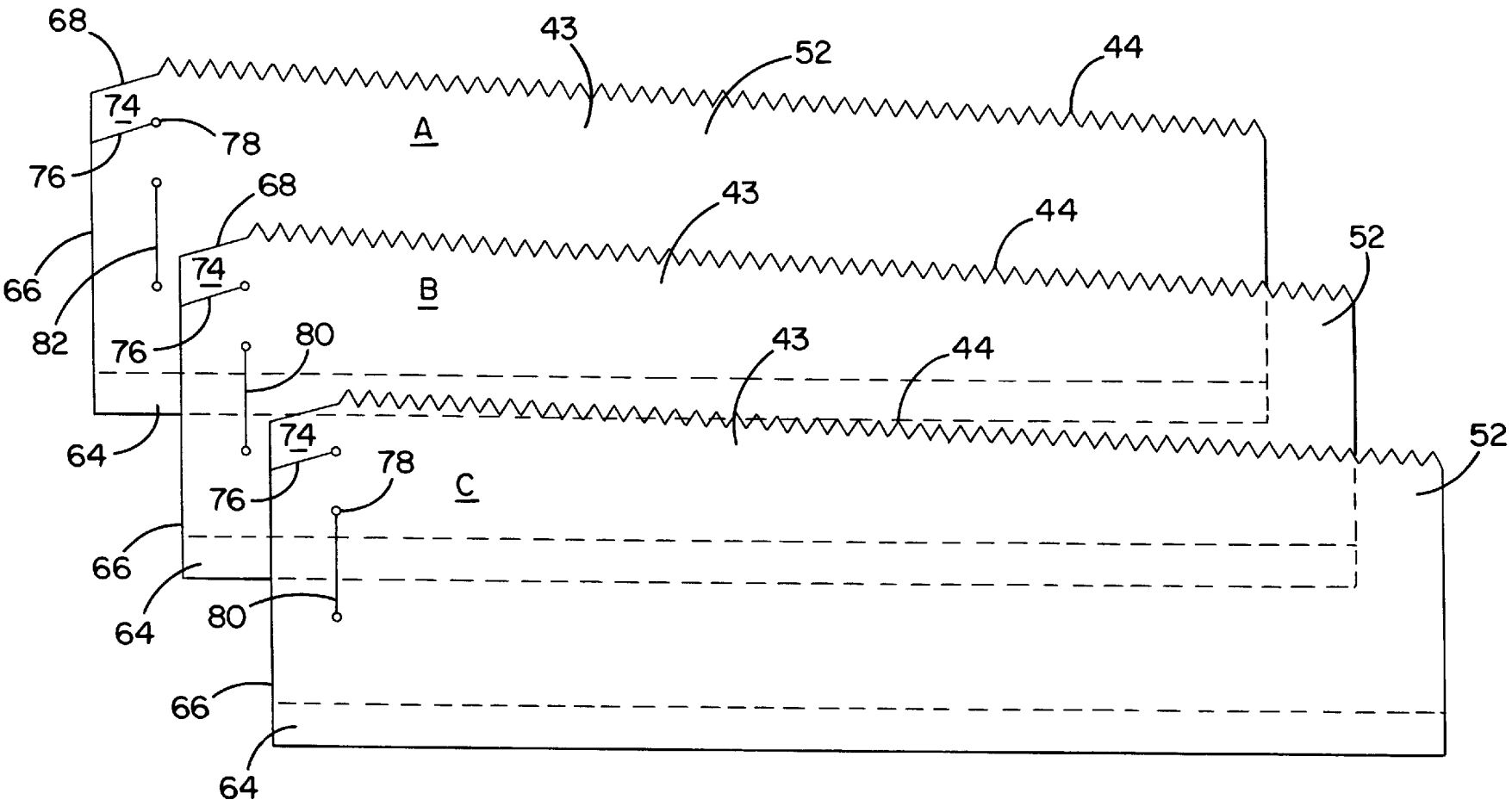
FIG. 8 is an exploded view of three flexible strips having a biased, toothed edge and interlocking ends.
Figure 9:
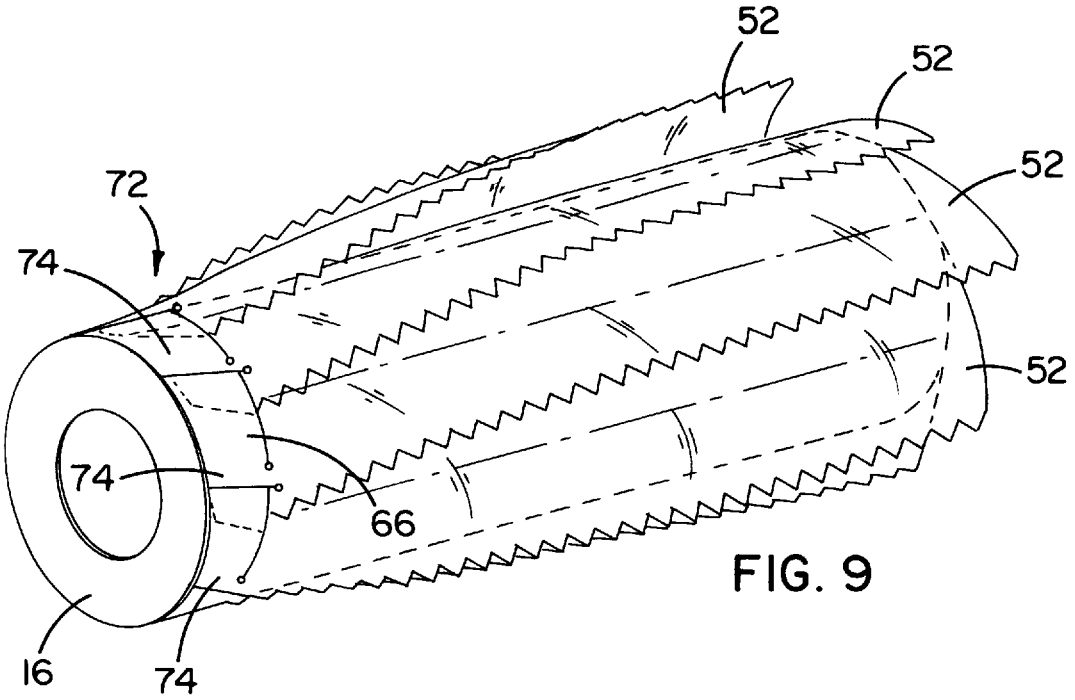
FIGS. 9 and 10 are views of the ends of the flexible strips interlocked to form a smaller diameter at one end of the roller.
Figure 10:
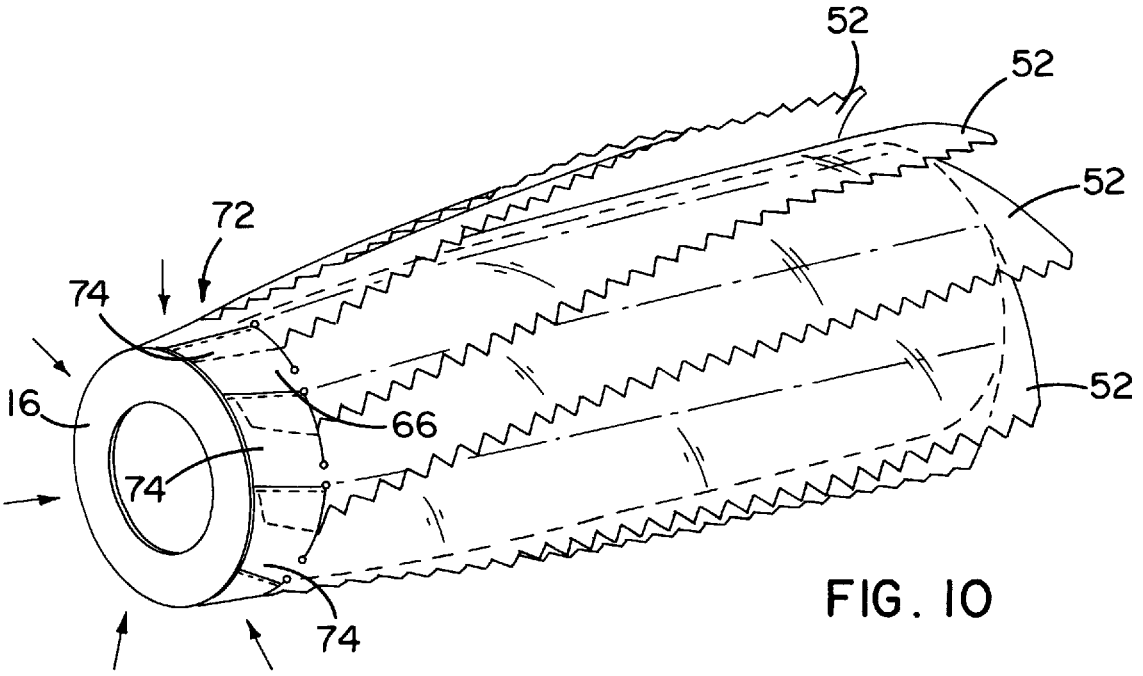

As best seen in FIGS. 8, 9 and 10, the side edges 66 of the respective toothed strips 52 may be interlocked or otherwise secured to the drum at one end to provide reduced diameter end 72 (FIGS. 9 and 10). In forming the reduced diameter end, it is preferred that the ends 66 of the strip be formed with smaller interlocking tabs 74 formed by making a slit 76 through the strip 52. A circular hole 78 at the end of the slit 76 prevents the slit from tearing further into the strip and weakening the tab. A tab on a strip is to be slid into and through a closed, vertical slot 80 in another strip. Herein, the tab 74 on the lower strip A is inserted through a slot 80 in the second strip B and is inserted under the other strip B. This tab of the lower strip c, when inserted through the slot of strip b, rests on top of a shoulder portion 82 of a third strip C so that the tab will slide easily as its associated strip 52 is flexed during a sanding operation. One or both ends of the strips may have tabs and/or the sloped edges to facilitate telescoping a sleeve from one or both sides of the drum.

Figure 5:
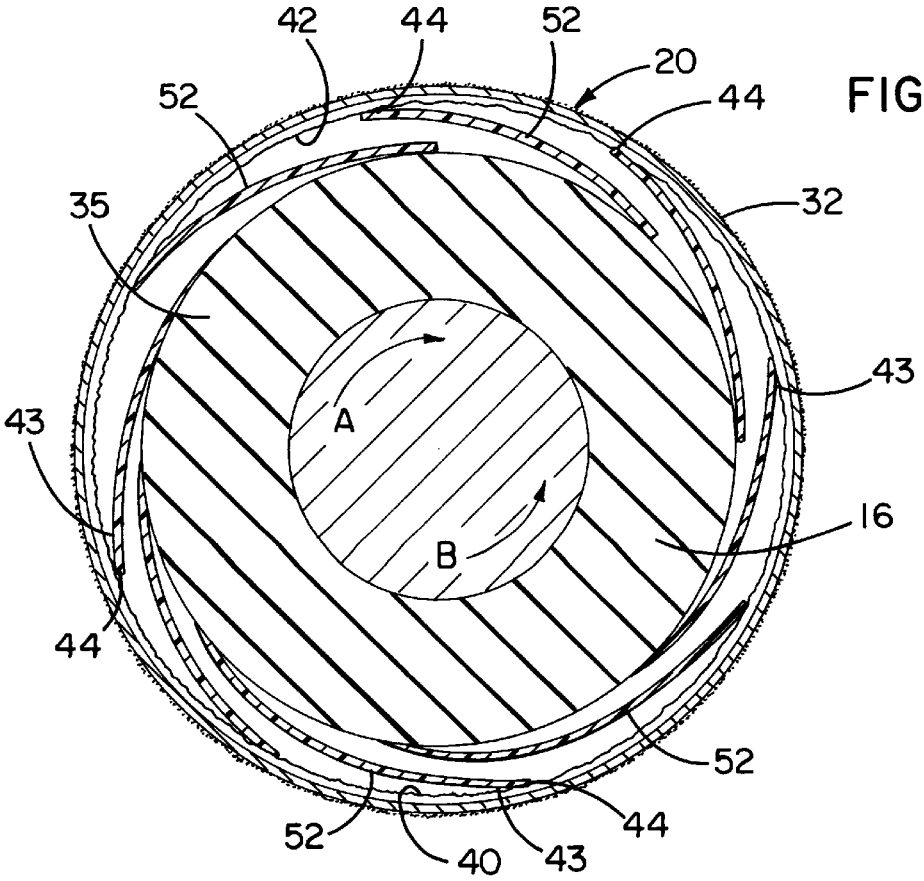
FIG. 5 is a view similar to FIG. 5, but taken along a radial line.

As best illustrated in FIG. 5, when the sleeve 20 is inserted onto the drum 16, the teeth 44 of the bent plastic strips 52 all point in the same direction along the circumference of the drum such that the teeth will engage the looped material 42 if the drum is rotated in a counterclockwise direction, as shown in FIG. 5.

When the sleeve 20 is completely inserted onto the drum 16, the drum and sleeve form an assembled drum and belt assembly and, as previously described above, the assembled drum and belt assembly are driven by he motor 12 to sand a workpiece 22.

As best seen in FIG. 5, the plastic clutch strips 52 have a spring bias to extend their serrated teeth 44 radially outwardly to hook into the looped material 42. When the drive drum is driven counterclockwise in the sanding direction in FIG. 5, the serrated teeth 44 dig into the looped filaments 42 to prevent slippage between the sleeve and drive drum.

Because of the flexibility of the stirps 52 and the slight compressibility of the hooked material sheet 40, the plastic strips flex during a sanding operation with the teeth 42 being pushed outwardly into the loops as the strip is pushed hard against the workpiece. It is preferred that the strips 52 be formed with the toothed edges at a slight bias angle to a straight line across the drum and parallel to the longitudinal axis of the drum. As best seen in FIG. 8, the teeth are canted downwardly and to the right.

After substantial use, a worn sleeve 20 can be removed from the drum 16 easily and replaced by a new sleeve. The worn sleeve is removed from the drum by simultaneously rotating the roller in the first direction, A, so that the teeth 44 do not engage the looped material 42 and pushing the sleeve off of the drum. Then, a new sleeve can be placed on the drum in the same manner described above.

What is claimed is:

1. An abrading drum for abrading a workpiece comprising:

a rotating drive drum having a substantially cylindrical shape;

a substantially cylindrical sleeve having an outer abrading surface thereon for abrading the workpiece;

the drive drum having a body of sufficient hardness that it is not compressed during the abrading operation; and a one-way clutch between the driving drum and the cylindrical sleeve allowing axial and rotational movement between the sleeve and the drive drum to position the sleeve on the drive drum and preventing relative, rotational movement between the sleeve and the drum in an abrading direction of rotation.

2. An abrading roller in accordance with claim 1 wherein a plurality of projections on the drum comprise a part of the one-way clutch.

3. An abrading roller in accordance with claim 2 wherein a fabric is provided on the interior of the abrading sleeve as a portion of the one-way clutch.

4. An abrading drum in accordance with claim 1 wherein a plurality of flexible strips are attached to a circumferential surface of the drum; and a hooked surface is formed on an inner face of the cylindrical sleeve for engagement with the tooth strips to drive the sleeve in the abrading direction.

5. An abrading drum in accordance with claim 4 wherein ends are formed on the strips to be engaged and cammed radially inwardly against the drum surface as the sleeve is telescoped on the drum.

6. An abrading drum in accordance with claim 5 wherein the ends of the strips are sloped in the direction of turning to insert the sleeve.

7. An abrading drum in accordance with claim 4 wherein interlocking ends are formed on the strips to interlock the strips at smaller diameters to facilitate insertion of the sleeve onto the strips.

8. An abrading drum in accordance with claim 7 wherein tabs are formed on one strip and slots are formed on an adjacent strip, the tab being inserted into a slot to interlock the strip ends at a smaller diameter.

9. An abrading drum in accordance with claim 8 wherein the tab on one strip slides across the surface of another strip as said one strip is flexed.

10. A sanding apparatus comprising:

a frame;

a motor mounted on the frame;

a cylindrical sleeve having an inner surface and an outer surface, said inner surface having an engagable material thereon;

an abrasive or sanding material on the outer surface of the cylindrical sleeve;

a cylindrical drum having an outer roller cylindrical surface which is hard an substantially incompressible when sanding and having a longitudinal axis;

a one-way clutch attached to said outer drum cylindrical surface which, when said drum is rotated in a first direction, allows said sleeve to slidingly rotate around and about said longitudinal axis of said drum and, when said sleeve is rotated in a second direction, said one-way clutch engages said engagable material on said inner surface of said sleeve and prevents said sleeve from rotating about said drum.

11. The sanding apparatus of claim 10 wherein said engagable material is sewing fleece.

12. The sanding apparatus of claim 10 wherein said engagable material is a looped material such as the looped material used in a hood and loop fastener assembly sold under the trademark VELCRO™.

13. The sanding mechanism of claim 10 wherein said one-way clutch includes at least two plastic strips each having a front end and a back end, said front ends each having teeth and said back ends each being attached to said drum;

and said strips are positioned one in front of the other and cover the entire circumference of the drum such that said front end of a first strip overlaps the back end of a second strip which is positioned directly in front of said first strip.

14. The sanding apparatus of claim 10 wherein said abrasive is sandpaper.

15. The sanding apparatus in accordance with claim 10 wherein the abrasive material is a non-woven abrasive material such as one sold under the trademark SCOTCH-BRITE™.

16. A roller, for use with a cylindrical sleeve having an inner surface containing an engagable material and an outer surface having sandpaper or other abrasive material thereon, comprising:

a cylindrical drum having an outer cylindrical surface, and a motor drive connected thereto;

sliding and gripping means attached to said drum which, when said sleeve is rotated in a first direction, allows said sleeve to slidingly rotate about the longitudinal axis of said drum and, when said sleeve is rotated in a second direction, said sliding and engaging means engages said engagable material on said inner surface of said sleeve and prevents said sleeve from rotating about said drum.

17. An abrading drum for abrading a workpiece comprising:

a rotating drive drum having a substantially cylindrical shape;

a substantially cylindrical sleeve having an outer abrading surface thereon for abrading the workpiece;

the drive drum having a body of sufficient hardness that it is not compressed during the abrading operation;

a one-way clutch between the driving drum and the cylindrical sleeve allowing axial and rotational movement between the sleeve and the drive drum to position the sleeve on the drive drum and driving the sleeve in an abrading direction of rotation;

the one-way clutch including a plurality of flexible strips attached to and extending circumferentially about the drive drum;

the flexible strips having outer free ends projecting radially outwardly about the circumference of the drum to drive the cylindrical sleeve; and the ends of the flexible strips being bent inwardly against the drum and retained thereat to provide a smaller diameter to facilitate insertion of the sleeve over the drum and strips.

18. An abrading drum in accordance with claim 1 wherein the one-way clutch comprises projections associated with the drum; and a material having holes thereon is provided on an inner bore of the sleeve to allow the projections to project into the holes to engage the clutch to drive the sleeve when abrading.

19. An abrading drum in accordance with claim 18 wherein the one-way clutch comprises a plurality of flexible strips;

the projections are in the form of teeth on edges of the strips with the teeth adapted to enter into driving relationship with the material through the holes therein.

20. An abrading drum in accordance with claim 1 wherein the one-way clutch includes a coarse material is on the interior of the sleeve; and projections associated with the drum to engage the coarse material to impart the turning torque from the drive drum to rotate the sleeve in the abrading direction.

21. An abrading drum in accordance with claim 20 wherein teeth are formed on the edges of the strips to engage the coarse material on the drum.

22. An abrading drum in accordance with claim 1 wherein the one-way clutch includes:

flexible strips on the drum having outer edges spaced outwardly of a circumferential surface on the drum; and securing means at one end of the drum holds the strips bent inwardly to conform to the circumferential surface of the drum to provide a reduced diameter end to facilitate telescoping of the sleeve over the flexible strips.

23. An abrading drum in accordance with claim 22 wherein the securing means comprises interlocking ends on the flexible strips to interlock the ends of the strips to provide the reduced diameter end.

* * * * *

UNITED STATES PATENT AND TRADEMARK OFFICE

CERTIFICATE OF CORRECTION

PATENT NO. : 5,890,953

DATED : April 6, 1999

INVENTOR(S) : Kenneth Evensen

It is certified that error appears in the above-indentified patent and that said Letters Patent is hereby corrected as shown below:

In the Title Page: Item [54], and Column 1, line 1, change "METHOD FOR" to--METHOD AND--.

Signed and Sealed this

Twentieth Day of July, 1999

*Attest:*

*Attesting Officer*

Q. TODD DICKINSON

*Acting Commissioner of Patents and Trademarks*